US007695210B1

(12) United States Patent
Martinez

(10) Patent No.: US 7,695,210 B1
(45) Date of Patent: Apr. 13, 2010

(54) SEAM SEALER APPLICATOR

(76) Inventor: Leo Martinez, 6381 Western Ave., Buena Park, CA (US) 90621-2832

( * ) Notice: Subject to any disclaimer, the term of this patent is extended or adjusted under 35 U.S.C. 154(b) by 1149 days.

(21) Appl. No.: 11/305,981

(22) Filed: Dec. 19, 2005

(51) Int. Cl.
*B43K 29/00* (2006.01)

(52) U.S. Cl. ..... 401/193

(58) Field of Classification Search ..... 401/9, 401/10, 48, 139, 193, 261–266; 222/566, 222/575

See application file for complete search history.

(56) References Cited

U.S. PATENT DOCUMENTS 2,930,063 A * 3/1960 Stull ..... 401/132
2,988,775 A * 6/1961 Painter et al. ..... 401/261
3,594,089 A * 7/1971 Powell et al. ..... 401/9
4,872,778 A * 10/1989 Longo ..... 401/266

OTHER PUBLICATIONS

Congoleum Applicator, 2 pages.
Mannington Seam Sealer Applicator, 3 pages.
Armstrong applicator,3 pages.
Tarkett Applicator, 3 pages.
Martinez/Mannington Applicator, 3 pages.
Armstrong European Applicator, 4 pages.
Armstrong S-590 Seam Coater Applicator, 3 pages.
Toli Cold Weld Seam Sealer, 2 pages.
PVC-Kaltschweißmittel, Werner Müller GmbH , 7 pages.
ProBac or Permiflex, Here's How to Do it, 2 pages.

* cited by examiner

*Primary Examiner*—Huyen Le
(74) *Attorney, Agent, or Firm*—Charles H. Thomas

(57) ABSTRACT

A seam sealing applicator for dispensing chemical sealant into seams between adjacent sheets of flooring is comprised of a sealant reservoir mounted atop an improved seam sealer applicator tip. The applicator tip of the invention has an elongated, hollow, rigid plastic body with a pair of laterally projecting wings or flanges between its proximal end which receives the sealant reservoir and its opposite, distal sealant dispensing end. The distal end of the plastic body terminates in a flat face, preferably oriented at an angle of about seventy degrees relative to the alignment of the linear sealant delivery duct formed within the body. A thin, hollow, narrow metal insert is set into the distal end of the body. A keel or fin portion of the metal insert protrudes beyond the flat face and projects into a seam between adjacent sheets of flooring. The fin portion of the metal insert defines a thin, narrow, dispensing slit through which sealant may be dispensed deep into the seam between sheets of adjacent flooring. A tracking sight ridge is preferably formed on the front of the applicator tip at the distal end thereof, directly above the flat sealant application flow face. The applicator tip body is at least three inches in length so that it can be gripped by the hand of the installer in a variety of different ways.

20 Claims, 9 Drawing Sheets

SEAM SEALER APPLICATOR

BACKGROUND OF THE INVENTION

1. Field of the Invention

The present invention relates to devices for applying chemical sealants to seams between adjacent sheets of flooring.

2. Description of the Prior Art

In the flooring trade sheets of flooring formed of linoleum and other thermoplastic or plastic composition materials are laid in relatively large sections, side-by-side and secured one by one with a chemical adhesive to a floor underlayment. The seams between adjacent sheets of flooring represent a particularly vulnerable location in the flooring installation. That is, although flooring installers attempt to abut adjacent sheets of flooring tightly against each other, there is always a seam between adjacent flooring sheets. Dirt and moisture can penetrate the seam and seep beneath the flooring sheets. This often results in a deterioration of the bond between the flooring and the underlayment. Such deterioration results in a separation of the flooring from the underlayment where the edges of the sheets of flooring abut.

To avoid these types of problems it is highly desirable for the seams between adjacent sheets of flooring to be sealed. Sealing can be performed by grooving the adjacent edges of the abutting sheets of flooring and filling the grove with a molten, thermoplastic sealant which bonds to the adjacent edges of the flooring and forms a seal when cool. This process is sometimes referred to as "hot welding". Alternatively, a chemical sealant can be applied to the abutting edges of the adjacent sheets of flooring to seal them together. This process is sometimes termed "cold welding". The sealing of adjacent sheets of flooring using chemical adhesives in this manner is widespread in this country, particularly in residential flooring installations. The chemical composition of flooring products utilized in residential installations lends itself to cold welding or chemical sealing with adhesive applied in liquid form at room temperature, rather than heat welding, due to the chemical composition of the flooring products typically utilized in residential installations.

A number of different seam sealing applicators have been devised to apply chemical adhesive sealants to the interfaces between abutting edges of sheets of flooring. Very typically, a flow or squeeze bottle of liquid adhesive will be equipped with a seam sealer applicator tip having an orifice through which the liquid chemical adhesive is directed into the seam between adjacent sheets of flooring. Several very popular seam sealing applicators of this type employ a fin or keel structure as a seam follower in order to ensure that the flooring installer is directing the chemical adhesive sealant directly into the seam between adjacent sheets of flooring, and not onto the adjacent flooring surfaces.

As the surfaces of flooring goods utilized in residential flooring have improved and become more durable, conventional seam sealing applicators have become less and less satisfactory. One very popular seam sealing applicator is formed with a plastic tip that narrows at its extremity and terminates in an orifice located above a small fin. The fin follows the abutting edges between adjacent sheets of flooring and serves as a wedge or plow to temporarily widen the gap between the abutting edges of flooring so as to allow the liquid sealants to flow down into the gap.

While this device is quite acceptable for many types of flooring, it has been found that the fin tends to break off when this applicator is utilized with the harder, more durable types of flooring now increasingly utilized in residential floors.

Also, even when utilized on softer flooring materials, a great deal of pressure is required to maintain the fin in the crevice between the adjacent sheets of flooring. The discharge end of the tip is quite narrow, so that the surface of force application is quite small and is located down at the flooring surface. Downward force can therefore only be applied to the tip by pressing downward on the lower extremity of the tip with the index finger of one hand.

A constant application of pressure by an installer using the index finger of one hand is fatiguing and also exposes the installer's index finger to the caustic effect of the seam sealing adhesive. In addition, the bead of sealant created is typically inordinately wide, thus leading to an unsightly appearance of the flooring on the edges adjacent the seam interface.

Another popular type of seam sealer applicator has a metal tip that has a T-shaped configuration. A narrow slit is formed in the vertically oriented leg of the T-shaped tip. However, a great deal of downward force is required in order to force the vertical leg of the T-shaped tip into the crevice between the adjacent sheets of flooring. The tip is quite narrow so that all of this force must be applied using only the tip of the installer's index finger. This creates considerable fatigue. It also exposes the index finger to an excessive amount of caustic sealant chemicals. Furthermore, the metal flanges of the tip tend to scrape and gouge the surface of the flooring on both sides of the seam between the flooring sheets.

Another type of conventional seam sealer applicator employs a brass tip that also has a T-shaped configuration. The orifice opening for dispensing the sealants is in the vertical leg of the T-shaped tip. While this device is effective for properly dispensing sealants deep into the seam, it tends to be self-sharpening. That is, as the device is used the depending leg of the applicator tip becomes sharper and sharper and tends to cut too deeply into the material. Also, this device, like many other conventional seam sealer applicators, requires an inordinate, fatiguing amount of force applied by only the installer's index finger of one hand. As with other conventional devices that necessitate the application of force by an installer utilizing a single index finger, the installer's finger is exposed to the irritating adhesives employed in the sealants.

SUMMARY OF THE INVENTION

The present invention is a new, improved seam sealer applicator that eliminates many of the disadvantages associated with conventional commercial flooring seam sealing applicators. The seam sealer tip of the present invention employs a narrow stainless steel fin in which a sealant dispensing slit is defined. The fin or keel from which the chemical sealant is dispensed will not break off like conventional plastic fins, even with the harder flooring surfaces now utilized in residential flooring installations. Consequently, the seam sealer tip of the invention will last far longer without degradation than conventional tips.

The flat face at the downstream end of the seam sealer tip body is oriented relative to the alignment of the body such that the sealant is dispensed while holding the tip at a relatively small angle tilted back from perpendicular alignment relative to the floor. This allows the tip to be held with one or more fingers wrapped around the tip body and with the tip held at an angle of only about twenty degrees from perpendicular orientation relative to the flooring. The seam sealer applicator tip can thereby be held much more comfortably in the hand of the flooring installer.

Furthermore, downward pressure can be applied by holding the tip in a number of different positions between the fingers of the installer. This allows the installer to shift finger positions from time to time, thus resulting in far less fatigue to the installer's hand. Also, the configuration of the tip avoids the necessity for applying constant downward pressure by the index fingertip of the installer. This not only reduces finger fatigue, but avoids the excessive contact by the installer's index finger with the seam sealant.

The stainless steel fin through which the sealant is dispensed is set into the downstream or distal end of the tip and protrudes therefrom so that when the tip is held in the normal position for dispensing sealant, a right triangular-shaped portion of the metal insert is exposed, as viewed in side elevation. The dispensing slit is formed in the longest side of this triangular portion, while the hypotenuse thereof lies at the flat, generally rectangularly shaped face of the distal end of the body into which the hollow metal insert is set. Since the exposed portion of the metal insert extends below the floor level, into the crevice between the adjacent sheets of flooring, sealant is dispensed deep into the interface between the abutting edges of the sheets of adjacent flooring.

The metal sealant dispensing insert is centered into the flat face at the distal end of the tip body. This flat face is only about 0.15 inches in width and about 0.25 inches in length. The very narrow configuration of the flat face from which the fin projects results in a very narrow bead of sealant remaining on the exposed surface of the abutting sheets of flooring. Furthermore, since the body of the tip is formed of plastic, the flat face at the distal end of the body does not gouge or scar the sheets of flooring as the seam sealer applicator is moved along the interface therebetween.

The dispensing tip of the invention is provided with a pair of laterally projecting wings or flanges which diverge laterally outwardly from the distal end of the tip and provide excellent gripping surfaces to allow an installer to apply pressure to control the movement of the seal sealer applicator. The degree of control in movement and orientation that the laterally projecting wings or flanges provide is considerably greater than that afforded by conventional seal sealer applicator tips.

The seam sealing tip is also provided with a tracking sight ridge that is formed in a plane perpendicular to the flat face of the distal end of the tip and adjacent and centered with respect thereto. Accordingly, by visually sighting along the tracking sight ridge, the installer is easily able to keep the applicator properly oriented and moving in the plane of the abutting edges of the sheets of flooring and at an orientation such that the metal insert dispensing sealant is maintained centered to travel straight in the crevice between the adjacent flooring sheets. The installer is thereby able to use the tracking sight ridge to avoid any slicing of the metal insert laterally into either of the abutting sheets of flooring. The orientation of the flat face at the downstream end of the tip is preferably at a angle that allows the installer to tilt the tip back from perpendicular alignment relative to the floor at an angle of only about twenty degrees.

Unlike conventional seam sealing applicator tips, the applicator tip of the present invention is relatively long. Preferably, it has a length of at least about three and a half inches. This extended length allows the installer to easily hold the tip within the fingers of the installer's hand while applying the sealant. The tip of the invention can thereby be held much more comfortably by the installer, which avoids fatigue and the resultant mistakes that occur so frequently utilizing conventional seam sealing tips, particularly in sealing seams between hard sheets of flooring supported on an underlayment.

In one broad aspect the present invention may be considered to be a seam sealer applicator tip for dispensing chemical sealant from a chemical reservoir into seams between adjacent sheets of flooring comprising a hollow, rigid plastic body and a narrow, hollow metal insert. The plastic body has an upstream end for receiving liquid sealant therein and an opposite downstream end for dispensing sealant. The plastic body has a flow duct therethrough that defines a straight, linear flow path at least three inches in length between the upstream and downstream ends. The body has a broadened region between the upstream and downstream ends that is at least 0.75 inches wide. The downstream of the body terminates in a flat face oriented at an angle of between about fifty-five degrees and about eighty degrees relative to the flow path.

The metal insert is set into the downstream end of the body and defines a fin portion having a forward edge and a rearward edge defining a narrow flow sealant dispensing slit therebetween aligned and in communication with the flow duct and oriented perpendicular to the flat face at the downstream end of the body. The rearward edge of the fin portion of the insert projects further from the flat face of the downstream end of the body than the forward edge of the fin portion.

The flat face is preferably oriented at an angle of between about sixty-five degrees and about seventy-five degrees relative to the flow path, and ideally at an angle of about seventy degrees relative to the flow path. The broadened region of the plastic body is preferably formed by a pair of flanges that project laterally in opposite directions from each other. Each of the flanges preferably extends at least about 0.5 inches laterally from the flow path.

Preferably also, the seam sealer applicator tip of the invention is comprised of a tracking sight ridge located on the exterior of the body and oriented in a plane perpendicular to the flat face and midway between the flanges.

The rearward edge of the fin portion of the tip preferably extends at least a distance of about 0.05 inches out beyond the flat face of the downstream end of the body. Preferably also, the sealant dispensing slit has cross-sectional dimensions of at least about 0.01 inches in width and at least about 0.15 inches in length, and the fin is no greater than about 0.20 inches in width. The flat face at the downstream end of the body is preferably no greater than about 0.20 inches in width and no greater than about 0.30 inches in length. Also, a metal cleaning blade is preferably removably insertable into the slit to keep the narrow slit unclogged when it is not in use.

In another broad aspect the invention may be considered to be a seam sealer applicator tip for dispensing chemical sealant into seams between adjacent sheets of flooring comprising: an elongated, hollow, rigid plastic body defining opposing proximal and distal ends and a thin, hollow, metal, narrow insert set into the distal end of the body. The plastic body has a straight, linear duct extending between its proximal and distal ends. The proximal end defines a mouth for receiving a receptacle of chemical sealant therein. The distal end terminates in a flat face oriented at an angle of between about fifty-five degrees and about eighty degrees relative to the linear duct. The body is at least three inches in length and has a broadened region between the proximal and distal ends that is at least 0.75 inches in width.

The metal insert has an exposed keel portion protruding beyond the flat face at the distal end of the body. The keel portion has forward and rearward ends that define a thin, narrow, dispensing slit therebetween the rearward end projects further from the flat face than the forward end. The rearward end projects from the flat face a distance of at least about 0.05 inches.

In still another aspect the invention may be considered to be a seam sealer applicator for dispensing adhesive in liquid form into seams between sheets of flooring. The applicator of the invention is comprised of a hollow reservoir containing a liquid adhesive and terminating in an outlet, a hollow, rigid plastic dispenser body that has a proximal end joined to the reservoir outlet and an opposite distal end, and a narrow, hollow metal insert set into the distal end of the dispenser body. The distal end of the dispenser body narrows to a flat face having a width of no greater than about 0.20 inches. The body has a broadened region that is at least 0.7 inches wide between the proximal and distal ends. The body is at least about three inches in length.

A straight, linear duct is defined through the body leading from the proximal end to the distal end thereof. The flat face is oriented at an angle of between about fifty-five degrees and about eighty-five degrees relative to the alignment of the linear duct.

The hollow metal insert has an upper portion anchored to the distal end of the body and an depending fin portion protruding downwardly from the flat face. The depending fin portion of the insert has a leading end and a trailing end. The trailing end extends further from the flat face than the leading end. A thin sealant dispensing slit is defined in the insert and extends between the leading and trailing ends of the fin portion of the insert.

The invention may be described with greater clarity and particularity by reference to the accompanying drawings.

DESCRIPTION OF THE EMBODIMENT

Figure 1:
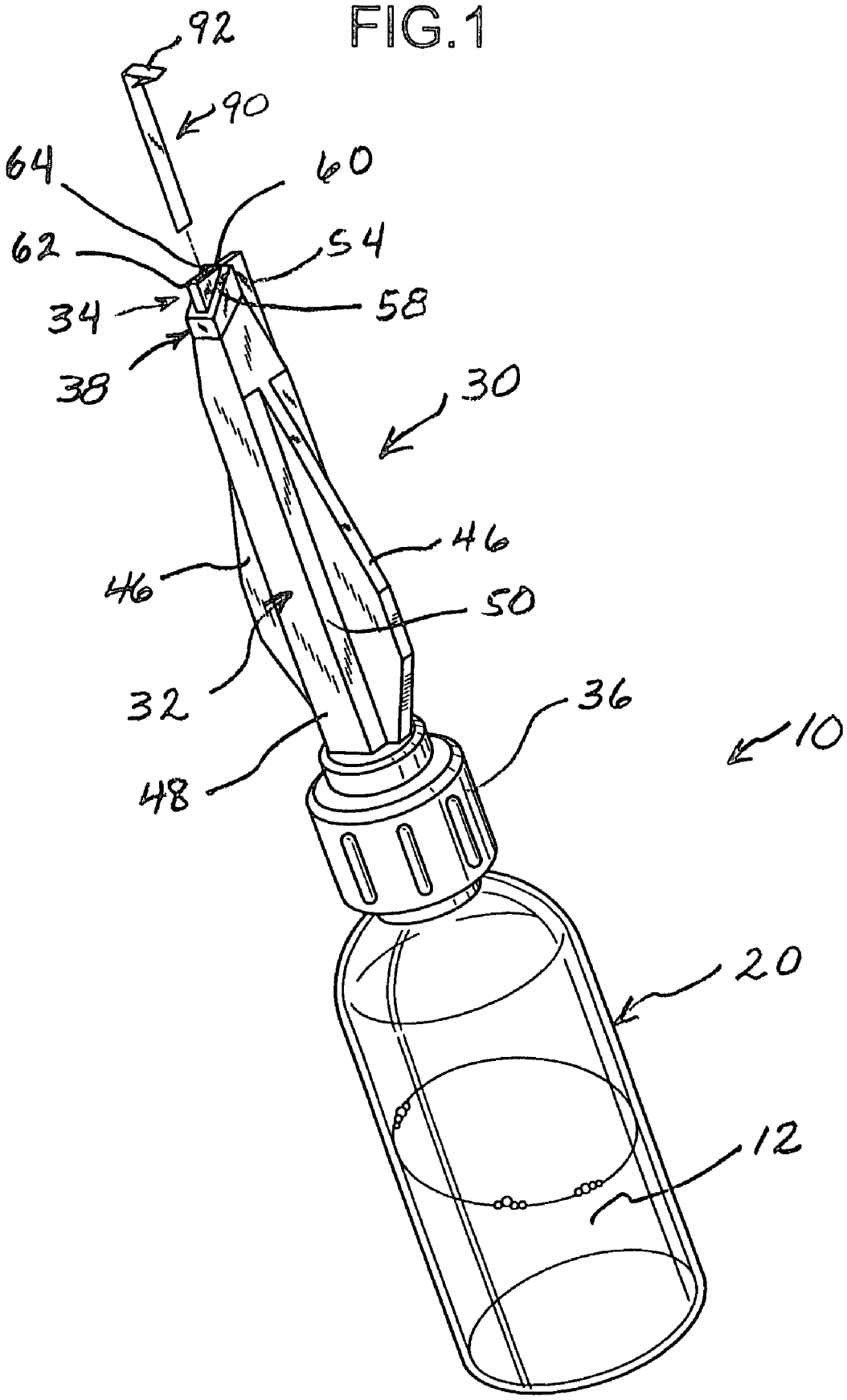
FIG. 1 is a perspective view of a seam sealer applicator constructed according to the invention.

FIG. 1 illustrates a seam sealer applicator 10 for dispensing chemical sealant adhesive in liquid form, indicated at 12, into seams 14 between adjacent sheet of flooring 16 and 18, as illustrated in FIGS. 2 and 7-10. As shown in FIG. 1, the seam sealer applicator 10 is comprised of a hollow, plastic reservoir 20, which is preferably a hollow plastic bottle having a threaded neck 22, visible in FIG. 2. The threaded neck 22 of the reservoir bottle 20 forms an outlet from the reservoir 20.

The applicator 10 is also comprised of a seam sealer applicator tip 30 which has a hollow, rigid, plastic body 32 and a narrow, hollow stainless steel insert 34. The plastic body 32 has a proximal, upstream end 36 formed as an internally threaded socket that screws onto the threaded neck 22 of the reservoir bottle 20, and an opposite, downstream, distal end 38. Because it is hollow, the plastic body 32 forms a flow duct 40 therethrough that defines a straight, linear flow path that is at least three inches in length between the opposite extremities of the upstream end 36 and the downstream end 38. The flow duct 40 is a narrow, tubular channel that has a straight, linear, longitudinal axis of alignment 42, indicated in FIG. 2.

Figure 4:
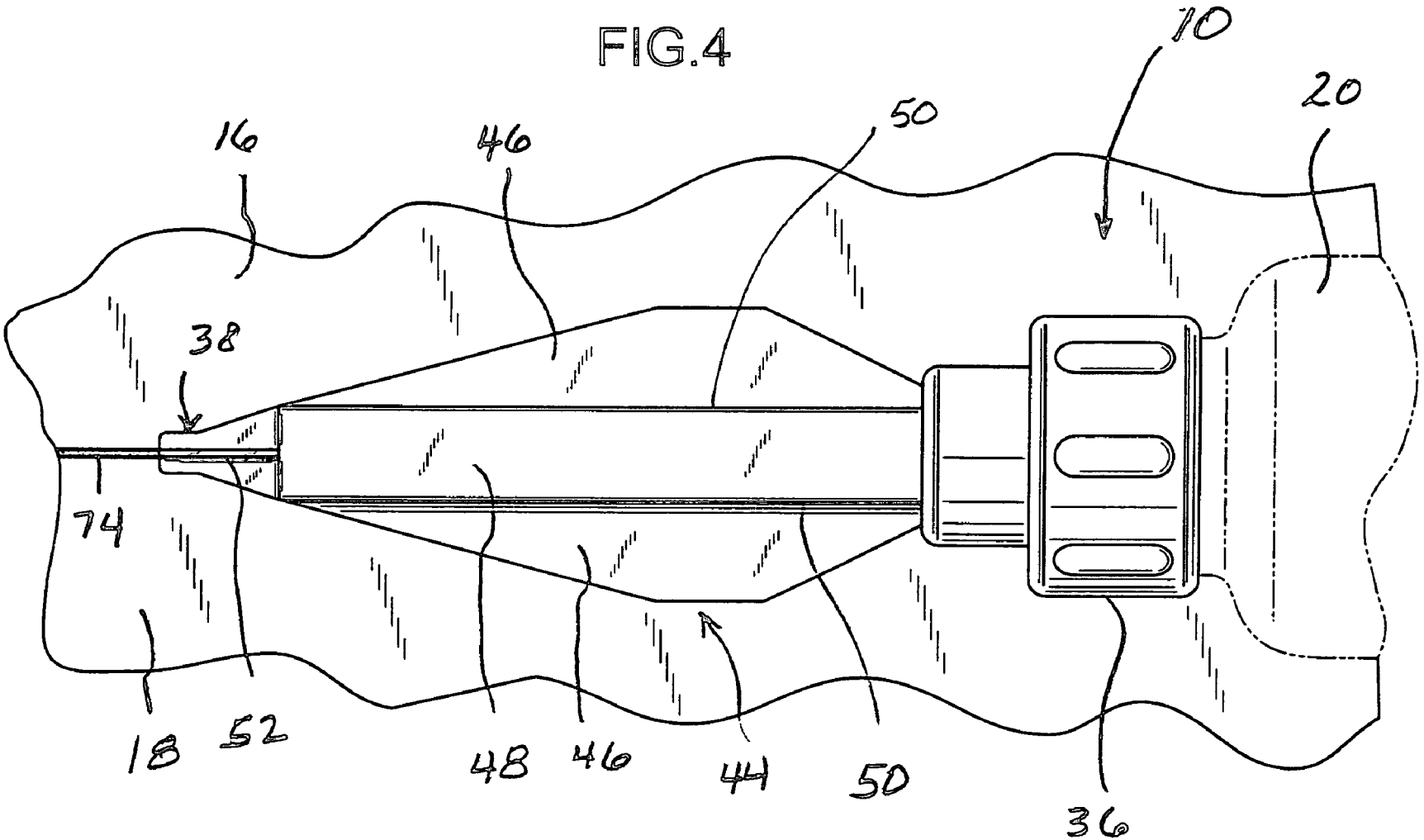
FIG. 4 is front view taken along the lines 4-4 of FIG. 2.

As best illustrated in FIG. 4, the plastic body 32 has a broadened region indicated at 44 between its upstream end 36 and its downstream end 38. The broadened region 44 is formed by a pair of wings or flanges 46 that extend laterally outwardly in opposite directions from the rectangular, hollow, tubular portion 48 of the body 32. The outboard extremities of the flanges or wings 46 extend at least about 0.5 inches laterally outwardly from the axis of alignment 42 of the flow duct 40. The flanges or wings 46 are preferably flat and their outboard extremities preferably extend a distance of at least 0.35 inches from the outboard walls 50 of the tubular portion 48 of the body 32.

The body 32 of the seam sealer applicator tip 30 is further comprised of a narrow tracking sight ridge 52 located at the downstream, distal end 38 of the body 32, immediately adjacent a flat flow face 54. The tracking sight ridge 52 is a narrow, dorsal ridge formed on the front of the exterior of the body 32.

Figure 2:
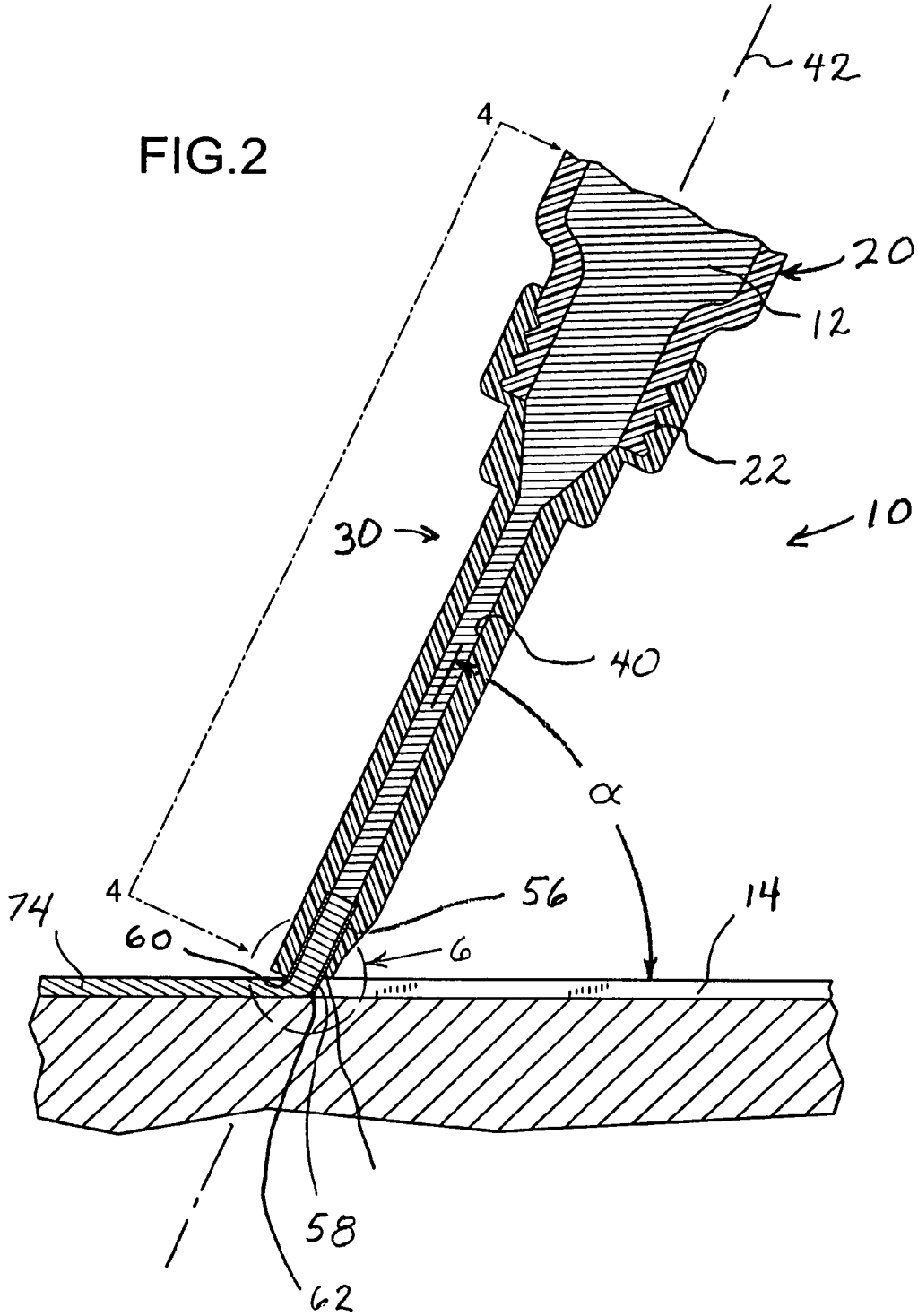
FIG. 2 is a side sectional view illustrating the seam sealer applicator tip of the invention in use dispensing sealant into a seam between adjacent sheets of flooring.
Figure 3:
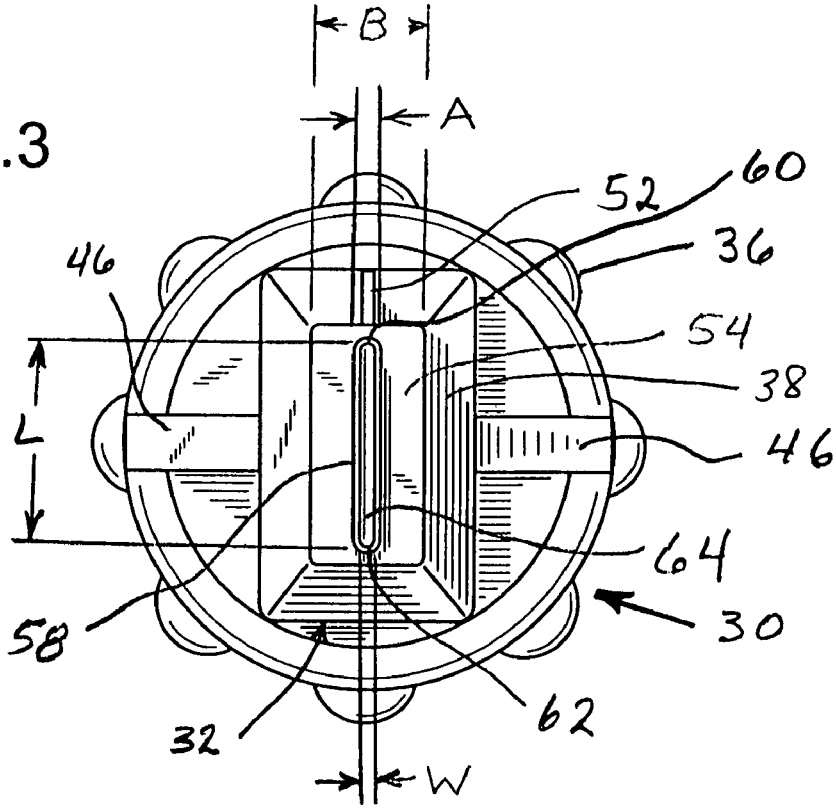
FIG. 3 is a plan detail view of the seam sealer applicator tip as viewed from a plane perpendicular to the axis of alignment of the seam sealer applicator tip.

As illustrated in FIGS. 1, 2, and 3, the downstream end 38 of the body 32 terminates in the flat flow face 54 that is oriented at an angle of between about fifty-five degrees and about eighty degrees relative to the alignment of the flow duct 40. In the embodiment illustrated the flat flow face 54 is oriented at an angle of about seventy degrees relative to the flow duct 40 and its axis of alignment 42.

Figure 5:
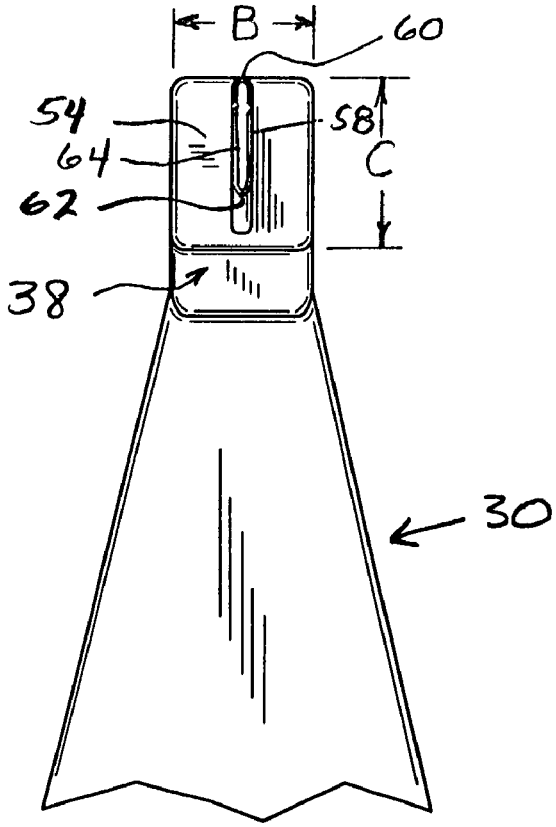
FIG. 5 is plan detail of the lower end of the applicator tip as viewed from a plane parallel to the flat face at the distal end of the applicator tip.

The hollow metal insert 34 is set and integrally molded into the downstream end 38 of the body 32 and defines an upper, anchored portion 56 and a lower, fin portion 58. The fin portion 58 of the metal insert 34 has a forward end 60 and a rearward end 62. A narrow sealant dispensing slit 64 is defined therebetween as illustrated in FIGS. 3 and 5. The sealant dispensing slit 64 is aligned with and is in communication with the flow duct 40.

Figure 6:
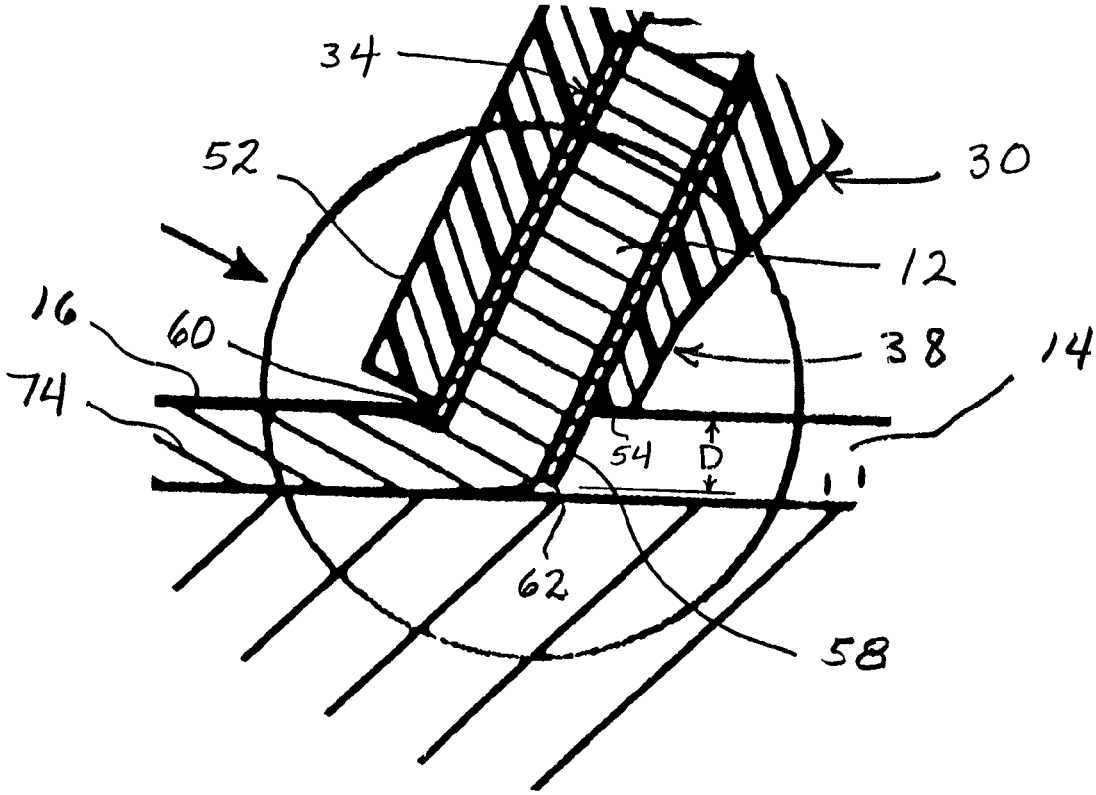
FIG. 6 is an enlarged detail of the distal end of the applicator tip as indicated at 6 in FIG. 2.

The fin portion 58 of the metal insert 34 is oriented perpendicular to the flat flow face 54 of the distal end 38 of the hollow plastic body 32. The rearward end 62 of the fin portion projects further from the flat flow face 54 of the downstream end 38 of the body 32 than the forward end 60 of the fin portion 58, as best illustrated in FIG. 6. As shown in FIG. 6, the rearward end 62 of the fin portion 58 extends at least a distance D of about 0.05 inches out beyond the flat flow face 54 of the downstream end 38 of the tip body 32. As illustrated in FIG. 3, the sealant dispensing slit 64 has cross-sectional dimensions of a width W that is at least 0.01 inches and a length L that is at least 0.15 inches, as measured between the interior wall surfaces of the narrow, hollow fin portion 58 of the metal insert 54. The fin portion 58 is no greater than about 0.20 inches in width A, as measured by the distance of separation of its exterior wall surfaces, as indicated in FIG. 3.

As shown in FIG. 5, the flat flow face 54 at the distal end 38 of the plastic body 32 has a generally elongated rectangular configuration, with slightly rounded corners. The width B of the flat flow face 54 should be no greater than about 0.20 inches, while the length C of the flat flow face 54 should be no greater than about 0.30 inches. As illustrated in FIG. 2, the flat flow face 54 of the distal end 38 of the body 32 is oriented at an angle $\alpha$ of about seventy degrees relative to the alignment of the duct 40.

As shown in FIGS. 2 and 6, the fin portion 58 of the metal insert 34 may also be considered to act as an exposed keel portion extending beyond the flat flow face 54. Also as illustrated in FIG. 2, the flat flow face 54 is oriented at an angle of about seventy degrees relative to the longitudinal axis of alignment 42 of the duct 40. This relatively small, rearward inclination allows a substantial portion of the hand and arm of the installer to be located behind the applicator 10 as it is moved along the seam 14 between the adjacent sheets of flooring 16 and 18.

Figure 7:
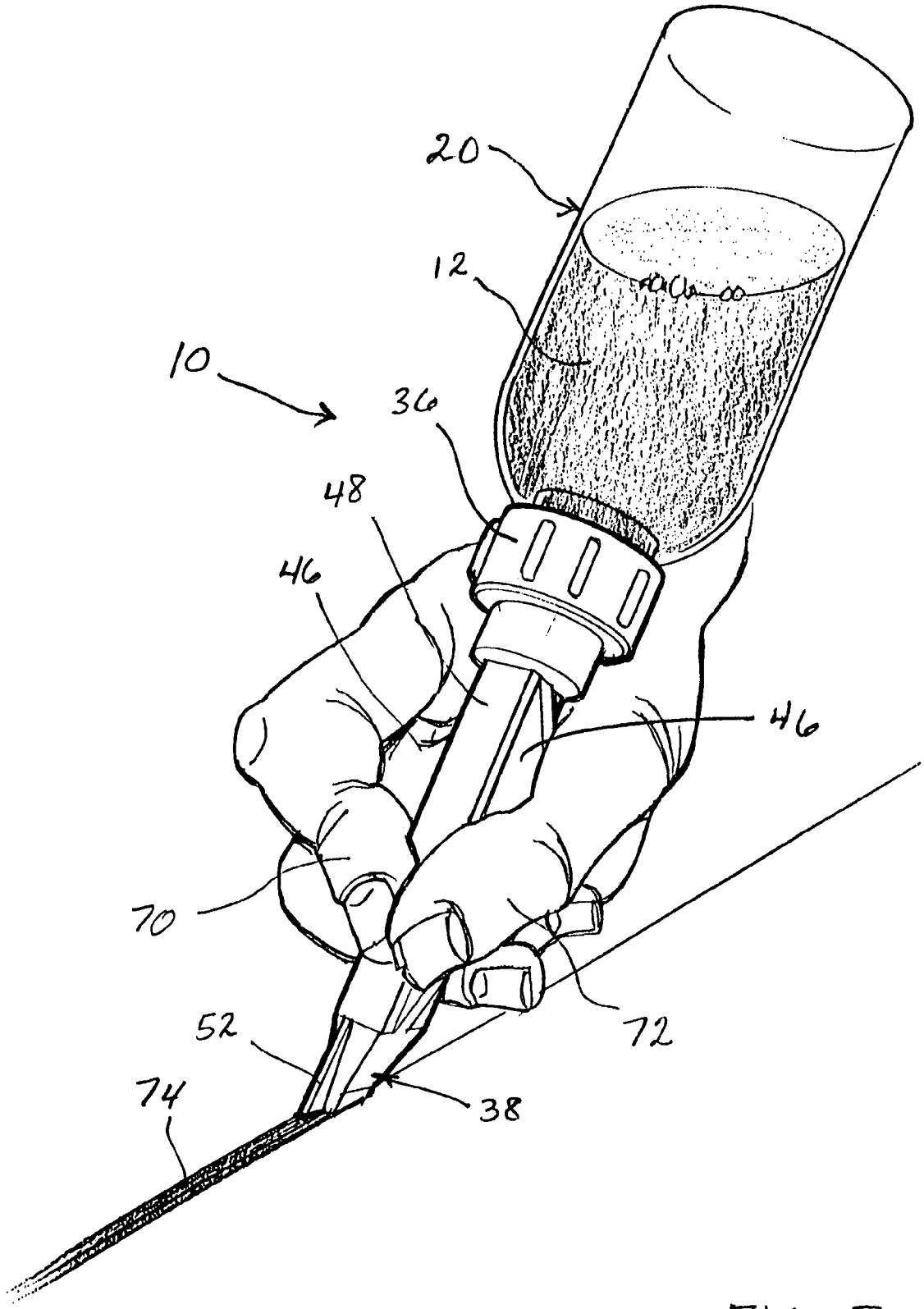
FIG. 7 is a perspective view illustrating one manner in which the seam sealer applicator of FIG. 1 can be held while in use.

As illustrated in FIGS. 7-10, it is unnecessary for the installer to exert a very large downward pressure utilizing only the installer's index finger 70 applied at the lowest extremity of the distal end 38 of the applicator tip body 32. Quite to the contrary, and as illustrated in FIG. 7, the flanges or wings 46 provide a relatively wide bearing surface by which the installer can exert a downward pressure utilizing both the thumb 72 and index finger 70 to ensure that the fin or keel portion 58 of the metal insert 34 is forced as deep as possible into the crevice 14 between the adjacent sheets of flooring 16 and 18.

As illustrated in FIGS. 2 and 7-10, a seal sealing applicator top 30 is inclined at only a twenty degree angle from perpendicular orientation relative to the sheets of flooring 16 and 18 in the direction of travel, which in the drawings figures is illustrated from left to right. That is, and with particular reference to FIG. 2, the sealant 12 flows from the reservoir receptacle 20 through the outlet thereof formed by the neck 22 and into the hollow, tubular portion 50 of the applicator tip 30. The sealant 12 flows along a linear path of travel, through the duct 40, and out of the applicator tip 30 through the narrow slit 64.

By gripping the applicator tip 30 in the manner illustrated in FIG. 7, the flat flow face 54 can be easily maintained in close, intimate, surface-to-surface contact with the upwardly facing surfaces of the sheets of flooring 16 and 18. This is because the installer is able to use force from along the length of both the index finger 70 and the thumb 72, applied through the wings or flanges 46 to press the distal end 38 of the plastic body 32 downwardly. The sealant will then flow out of the slit 64 in the metal insert 34 and deep into the seam 14 between the sheets of flooring 16 and 18. A relatively deep penetration of sealant is achieved since the rear end 62 of the fin portion 58 of the metal insert 34 extends so deeply into the crevice of the seam 14. This dept of penetration improves the seal achieved between the abutting edges of the sheets of flooring 16 and 18. The dept of penetration of the fin portion 58 is enhanced by the very narrow width of the fin portion 58 of the metal insert 34.

Also, because the flat flow face 54 of the distal end 38 of the plastic body 32 is so narrow, the bead of sealant 74 that is applied to the margins of the sheets of flooring 16 and 18 at the seam 14 therebetween is also quite narrow. That is, the sealant bead 74 is typically no greater than about one-eighth of an inch in width. Furthermore, because the flat flow face 54 of the distal end 38 of the applicator 10 is plastic, it will not scratch or mar the surfaces of the flooring sheets 16 and 18.

As is evident from FIGS. 4 and 7-10, the tracking sight ridge 52 forms a clear reference to the installer that aids in preventing inadvertent lateral tilting of the plastic body 32 and also aids in maintaining a relationship of coplanar alignment of the tracking sight ridge 52, the fin portion 58 of the metal insert 34, and the seam 14.

Figure 8:
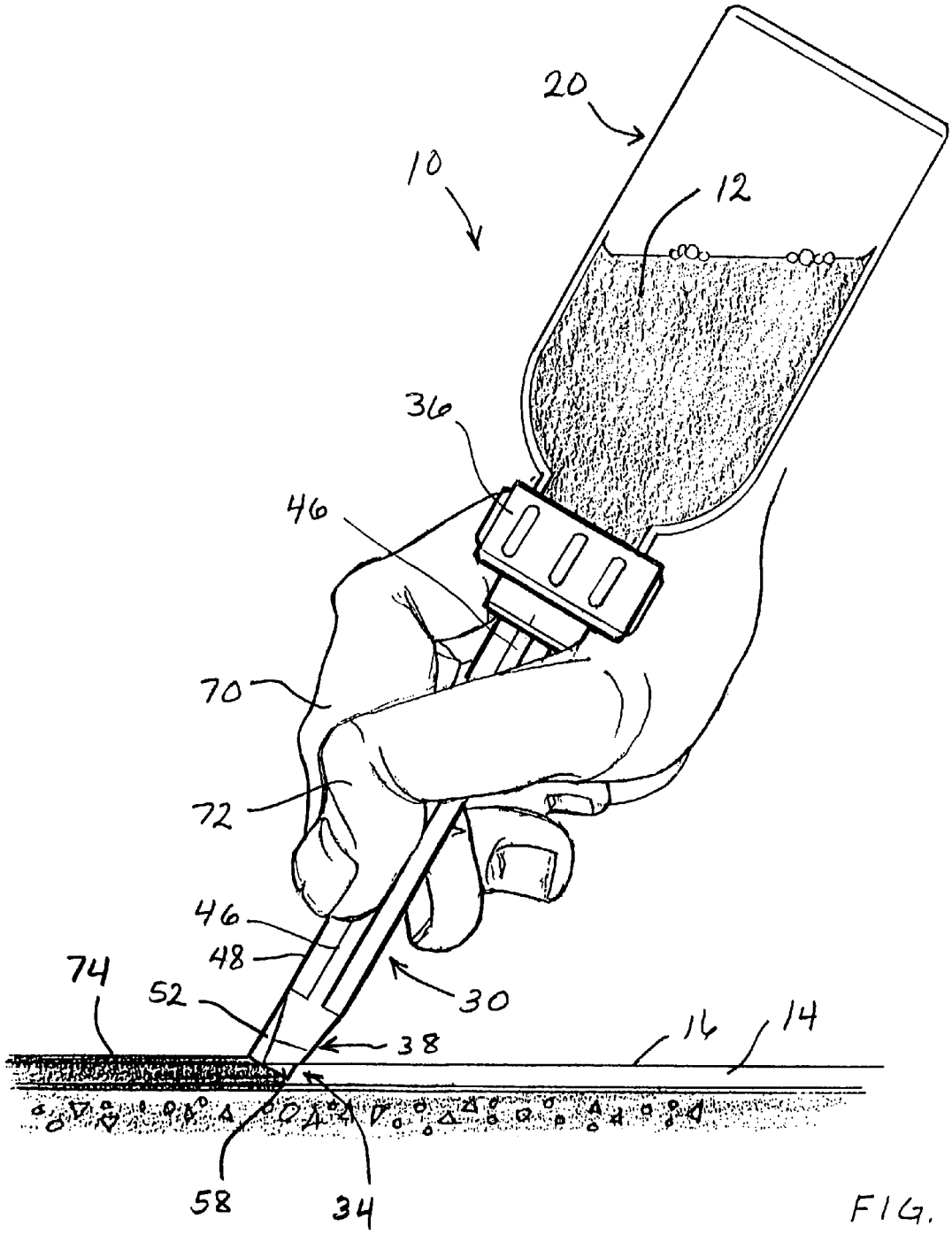
FIG. 8 is a side elevational view illustrating the manner in which the seam sealer applicator of FIG. 1 is used as shown in FIG. 7.

The seam sealing applicator 10 is further highly advantageous in that the tip 30 thereof can be effectively gripped in such a wide variety of ways that the installer can shift the position of his thumb 72 and fingers 70, 76, 78, and 80. That is, probably the most comfortable position of use of the applicator tip 30 for an installer to apply sealant 12 to seams 14 is for the installer to grip the plastic tip 30 much like one would grip a pen or pencil. This grip is illustrated in FIGS. 7 and 8.

Figure 9:
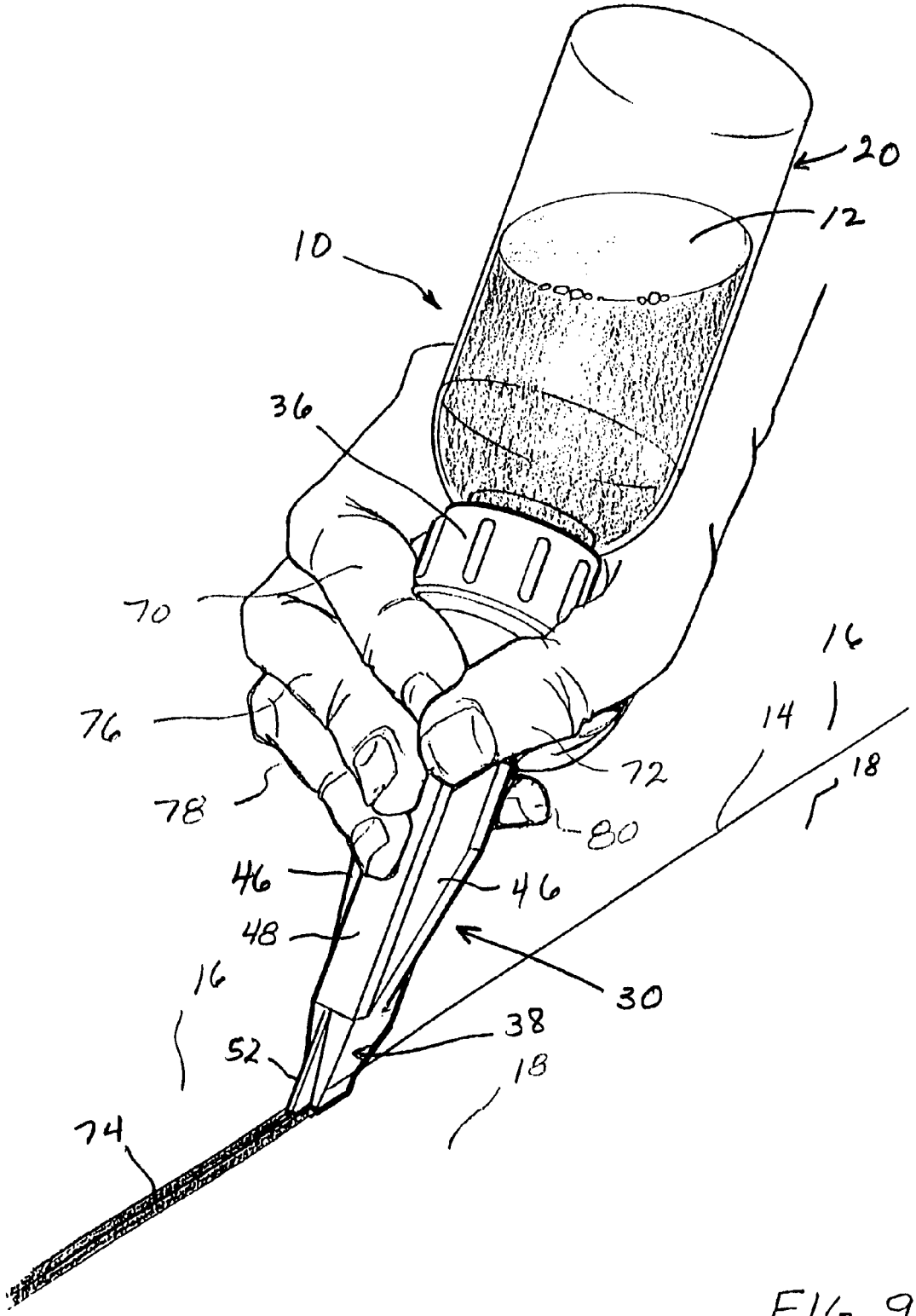
FIG. 9 is a perspective view illustrating another manner in which the seam sealer applicator of FIG. 1 can be held while in use.

However, even a relatively comfortable manner of gripping the applicator tip 30 can become fatiguing over a period of time. Therefore, the configuration and construction of the applicator tip 30 is such that it can be effectively held and used in a number of different ways. For example, FIG. 9 illustrates an installer gripping the applicator tip 30 with the thumb 72 and the first three fingers 70, 76, and 78 located atop and at the front of the plastic body 32. Only the little finger 80 is located behind the applicator tip 30. The grip of FIG. 9 provides the installer with an alternative position in which the seam 14 can be filled with a bead 74 of sealant if the installer's hand becomes fatigued from gripping the tip 30 in the manner illustrated in FIGS. 7 and 8.

Figure 10:
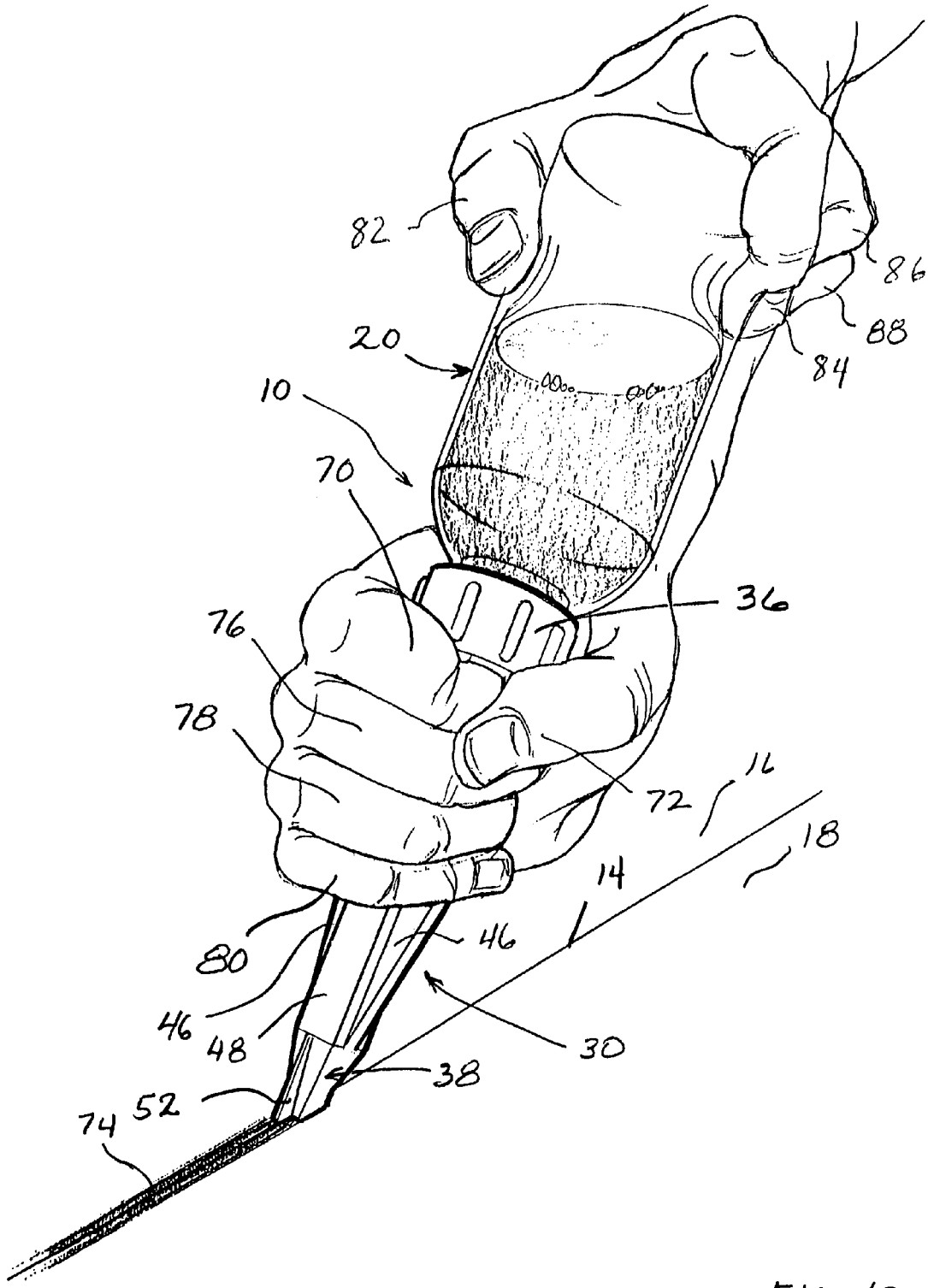
FIG. 10 is a perspective view illustrating still another manner in which the seam sealer applicator of the invention can be held during use.

FIG. 10 illustrates still another alternative way of gripping the seam sealing applicator 10. In this embodiment the installer wraps all four fingers 70, 76, 78, and 80 of one hand around the applicator tip 30 from one side, while wrapping the thumb 72 around the applicator tip 30 from the opposite side. The sealant reservoir 12 can be stabilized using the thumb 82 and fingers 84, 86, and 88 of the other hand in the manner illustrated.

By shifting positions of one's fingers and thumbs upon the tip 30 and/or the applicator reservoir 20, the installer can greatly reduce finger fatigue and thereby apply the bead 74 of sealant in a highly professional and workmanship-like manner.

Preferably, the applicator tip 30 is provided with a narrow metal cleaning blade 90 having cross-sectional dimensions that allow it to just fit within the slit 54. The blade 90 has a hooked upper end 92 that can be gripped to insert and remove the blade 90 from the slit 54. The blade 90 is inserted into the slit 64 when the applicator 10 is not in use. The presence of the blade 90 prevents the slit 54 from becoming clogged with sealant when the sealant applicator 10 is stored or temporarily set aside.

Undoubtedly, numerous variations and modifications of the invention will become readily apparent to those familiar with sealing seams between adjacent sheets of flooring. Accordingly, the scope of the invention should not be construed as limited to this specific embodiment depicted and described, but rather is defined in the claims appended hereto.

I claim:

1. A seam sealer applicator tip for dispensing chemical sealant from a sealant reservoir into seams between adjacent sheets of flooring comprising a hollow, rigid plastic body having an upstream end for receiving liquid sealant therein, an opposite downstream end for dispensing sealant therefrom and having a flow duct therethrough that defines a straight, linear flow path at least three inches in length between said upstream and downstream ends, and said body has a broadened region between said upstream and downstream ends that is at least 0.75 inches wide, and said downstream end of said body terminates in a flat face oriented at an angle of between about fifty-five degrees and eighty degrees relative to said flow path, and a narrow, hollow, metal insert is set into said downstream end of said body and defines a fin portion having a forward end and a rearward end defining a narrow sealant dispensing slit therebetween aligned and in communication with said flow duct, and said fin portion is oriented perpendicular to said flat face, and said rearward end of said fin portion of said insert projects further from said flat face of said downstream end of said body than said forward end of said fin portion.

2. A seam sealer applicator tip according to claim 1 wherein said flat face is oriented at an angle of between about sixty-five degrees and about seventy-five degrees relative to said flow path.

3. A seam sealer applicator tip according to claim 2 wherein said flat face is oriented at an angle of about seventy degrees relative to said flow path.

4. A seam sealer applicator tip according to claim 2 wherein said broadened region of said plastic body is formed by a pair of flanges that project laterally in opposite directions from each other and each of said flanges extends to at least about 0.5 inches laterally from said flow path.

5. A seam sealer applicator tip according to claim 4 further comprising a tracking sight ridge located on the exterior of said body adjacent said flat face and oriented in a plane perpendicular to said flat face and midway between said flanges.

6. A seam sealer applicator tip according to claim 2 wherein said fin portion is formed of stainless steel and said rearward end of said fin portion extends at least a distance of about 0.05 inches out beyond said flat face of said downstream end of said body.

7. A seam sealer applicator tip according to claim 6 wherein said sealant dispensing slit has cross-sectional dimensions of at least about 0.01 inches in width and at least about 0.15 inches in length.

8. A seam sealer applicator tip according to claim 7 wherein said fin is no greater than about 0.20 inches in width.

9. A seam sealer applicator tip according to claim 2 further comprising a metal cleaning blade removably insertable into said slit.

10. A seam sealer applicator tip according to claim 1 wherein said flat face is no greater than about 0.20 inches in width.

11. A seam sealer applicator tip according to claim 10 wherein said flat face is no greater than about 0.30 inches in length.

12. A seam sealer applicator tip for dispensing chemical sealant into seams between adjacent sheets of flooring comprising an elongated, hollow, rigid plastic body defining opposing proximal and distal ends and a straight, linear duct extending therebetween and wherein said proximal end defines a mouth for receiving a receptacle of chemical sealant therein and said distal end terminates in a flat face oriented at an angle of between about fifty-five degrees and about eighty degrees relative to said linear duct, and said body is at least three inches in length and has a broadened region between said proximal and distal ends that is at least 0.75 inches in width, and a thin, hollow, narrow metal insert set into said distal end of said body and which has an exposed keel portion protruding beyond said flat face, and said keel portion has forward and rearward ends with a thin, narrow, dispensing slit defined therebetween, and said rearward end projects further from said flat face than said forward end and said rearward end projects from said flat face a distance of at least about 0.05 inches.

13. A seam sealer applicator tip according to claim 12 wherein said flat face at said distal end is oriented at an angle of about seventy degrees relative to said duct.

14. A seam sealer applicator tip according to claim 13 wherein said broadened region of said body is formed by a pair of wings that project laterally from said body on opposing sides of said duct and said wings are each at least about 0.4 inches in width.

15. A seam sealer applicator tip according to claim 14 further comprising a narrow tracking sight ridge projecting from said body perpendicular to and equidistant from said wings and adjacent said flat face.

16. A seam sealer applicator tip according to claim 14 wherein said slit is between about 0.01 and 0.10 inches in width and between about 0.15 and about 0.30 inches in length in cross section.

17. A seam sealer applicator tip according to claim 16 wherein said keel portion is formed of stainless steel and has a width of no greater than about 0.20 inches.

18. A seam sealer applicator tip according to claim 17 wherein said flat face is no greater than about 0.20 inches in width.

19. A seam sealer applicator for dispensing adhesive in liquid form into seams between sheets of flooring comprising:

a hollow reservoir containing a liquid adhesive and terminating in an outlet, and a hollow, rigid plastic dispenser body that has a proximal end joined to said reservoir outlet and an opposite distal end that narrows to a flat face having a width no greater than about 0.20 inches and said body has a broadened region that is at least 0.75 inches wide between said proximal and distal ends and said body is at least about three inches in length, and a straight linear duct is defined through said body leading from said proximal end to said distal end, and said flat face is oriented at an angle of between about fifty-five degrees and about eighty degrees relative to the alignment of said linear duct, and a narrow, hollow metal insert is set into said distal end of said dispenser body and said metal insert has an upper portion anchored to said distal end of said body and a depending fin portion protruding downwardly beyond said flat face and said depending fin portion of said insert has a leading end and a trailing end that extends further from said flat face than said leading end, and a thin adhesive dispensing slit is defined in said insert and extends between said leading and trailing ends of said fin portion of said insert.

20. A seam sealer applicator according to claim 19 wherein said trailing end of said fin portion projects at least about 0.05 inches from said flat face, said slit is between about 0.01 and 0.10 inches in width and between about 0.15 and about 0.30 inches in length in cross section, said broadened region of said body is at least about one inch wide and said body is about four inches in length.

* * * * *